US008314367B2

(12) United States Patent
Gallo

(10) Patent No.: US 8,314,367 B2
(45) Date of Patent: Nov. 20, 2012

(54) ASSEMBLY FOR WARMING TOWELS AND THE AMBIENT AIR

(75) Inventor: Christopher J. Gallo, North Canton, OH (US)

(73) Assignee: Heat Surge, LLC, Canton, OH (US)

( * ) Notice: Subject to any disclaimer, the term of this patent is extended or adjusted under 35 U.S.C. 154(b) by 485 days.

(21) Appl. No.: 12/616,410

(22) Filed: Nov. 11, 2009

(65) Prior Publication Data

US 2010/0224615 A1 Sep. 9, 2010

Related U.S. Application Data

(60) Provisional application No. 61/157,703, filed on Mar. 5, 2009.

(51) Int. Cl.
*H05B 3/02* (2006.01)
*H05B 3/06* (2006.01)

(52) U.S. Cl. ..... 219/385; 219/521

(58) Field of Classification Search ..... 219/385, 219/521

See application file for complete search history.

(56) References Cited

U.S. PATENT DOCUMENTS

| | | | | |
|---|---|---|---|---|
| 2,971,266 | A * | 2/1961 | Silva | 34/621 |
| 4,395,233 | A * | 7/1983 | Smith et al. | 432/176 |
| 4,516,012 | A * | 5/1985 | Smith et al. | 219/400 |
| 4,927,995 | A * | 5/1990 | Lovett et al. | 219/385 |
| 6,046,436 | A * | 4/2000 | Hunts | 219/400 |
| 6,840,589 | B2 * | 1/2005 | Uri | 312/228.1 |

* cited by examiner

*Primary Examiner* — David S Blum
(74) *Attorney, Agent, or Firm* — Sand & Sebolt

(57) ABSTRACT

A heating unit comprising an outer shell defining a portion of the heating unit periphery, an inner shell disposed within the outer shell and defining an internal cavity, an intermediate cavity formed by the inner and outer shells, a plurality of openings in the inner shell providing air flow between the intermediate cavity and the internal cavity, a heating source, a distribution device transferring heated air from the heating source to the intermediate cavity, a plurality of ambient air vents, and wherein the heated air traverses the plurality of ambient air vents and the plurality of openings.

14 Claims, 18 Drawing Sheets

40
72
70
65
60
61
62
74
54
106
56
98
58
42
67
102
68
104
33
31
43
76
36
80
82
90
108
50
86
36
86
88
53
88
86
36
82
32
36
88
36
86
108
88
82
82
51
78
100
44
92
88
53
91
94
52
55
91
48
93
38
96
94
20
96
46

ASSEMBLY FOR WARMING TOWELS AND THE AMBIENT AIR

CROSS REFERENCE TO RELATED APPLICATIONS

This application claims priority from U.S. Provisional Application Ser. No. 61/157,703 filed Mar. 5, 2009; the disclosure of which is incorporated herein by reference.

BACKGROUND OF THE INVENTION

1. Technical Field

The invention relates generally to a towel warmer. More particularly, the invention relates to a heating unit for warming towels and the ambient air adjacent the unit. Specifically, the invention relates to a heating unit housed within a piece of furniture or a wall for warming towels as well as the ambient air.

2. Background Information

Towel warmers are useful to insure that a towel is dry and fresh. People also generally prefer a warm towel because the ambient air outside the shower or bathtub is cooler than the warm water and air within the shower. Further, the towel warmer can be used to dry a wet towel as well as keeping the towel warm before use.

Towel warmers traditionally come in two different styles. The first style is a sealed container with either a front opening door or a top opening door. The top opening version is convenient because the warmer can use any large enough floor space and the user simply opens the top to retrieve a heated towel. At the same time, the top opening version is inconvenient because valuable floor space is lost and the warmer is not aesthetically pleasing. The front opening version is generally smaller than the top opening version and is not free standing which means that the towel warmer must be placed on a stand or counter. Since the warmer is on a stand or counter, valuable space is once again lost.

The second and more popular style is the bar or straight towel warming rack. The straight towel warmer includes numerous bars arranged parallel to each other and generally inline. The warmer is either plugged into a wall outlet or hard-wired so that each bar is heated. This means that the entire warmer is heated even though only a portion of the warmer is being used. The warmer is highly inefficient because only those portions of the towel that contact one of the bars will be heated, and any additional heat is wasted. Further, since the straight towel rack has a number of bars, the towel rack tends to be much larger. Finally, the towel warmer rack may be a free standing version or a wall mounted version. Once again each version has its particular issues. The freestanding version takes up valuable floor space, while the wall mounted version is not aesthetically pleasing and will leave holes if the warmer is removed.

Thus, there is a long felt need in the art for an aesthetically pleasing and efficient towel warmer which does not take up valuable floor space while also heating the ambient air.

SUMMARY OF THE INVENTION

The present invention broadly comprises a heating unit comprising an outer shell defining a portion of the heating unit periphery, an inner shell disposed within the outer shell and defining an internal cavity, an intermediate cavity formed by the inner and outer shells, a plurality of openings in the inner shell providing air flow between the intermediate cavity and the internal cavity, a heating source, a distribution device transferring heated air from the heating source to the intermediate cavity, a plurality of ambient air vents, and wherein the heated air traverses the plurality of ambient air vents and the plurality of openings.

The present invention also broadly comprises a heating unit including a shell defining a portion of the heating unit periphery in an internal cavity, at least one rack for holding towels located within the internal cavity, a heating source, a distribution device transferring a heated air from the heating source to the internal cavity, a plurality of ambient air vents, and wherein the heated air traverses the plurality of ambient air vents to heat the ambient air.

The present invention further broadly comprises a method of warming a towel including the steps of holding a towel within an internal cavity of a heating unit, directing ambient air through a heating source with a distribution device, forcing a heated air from the heating source into the internal cavity and through a plurality of ambient air valves, warming the towel with the internal cavity heated air, and warming the ambient air with the heated air.

BRIEF DESCRIPTION OF THE DRAWINGS

The preferred embodiment of the invention, illustrative of the best mode in which Applicants have contemplated applying the principles of the invention, are set forth in the following description and are shown in the drawings.

DESCRIPTION OF THE PREFERRED EMBODIMENTS

Figure 1:
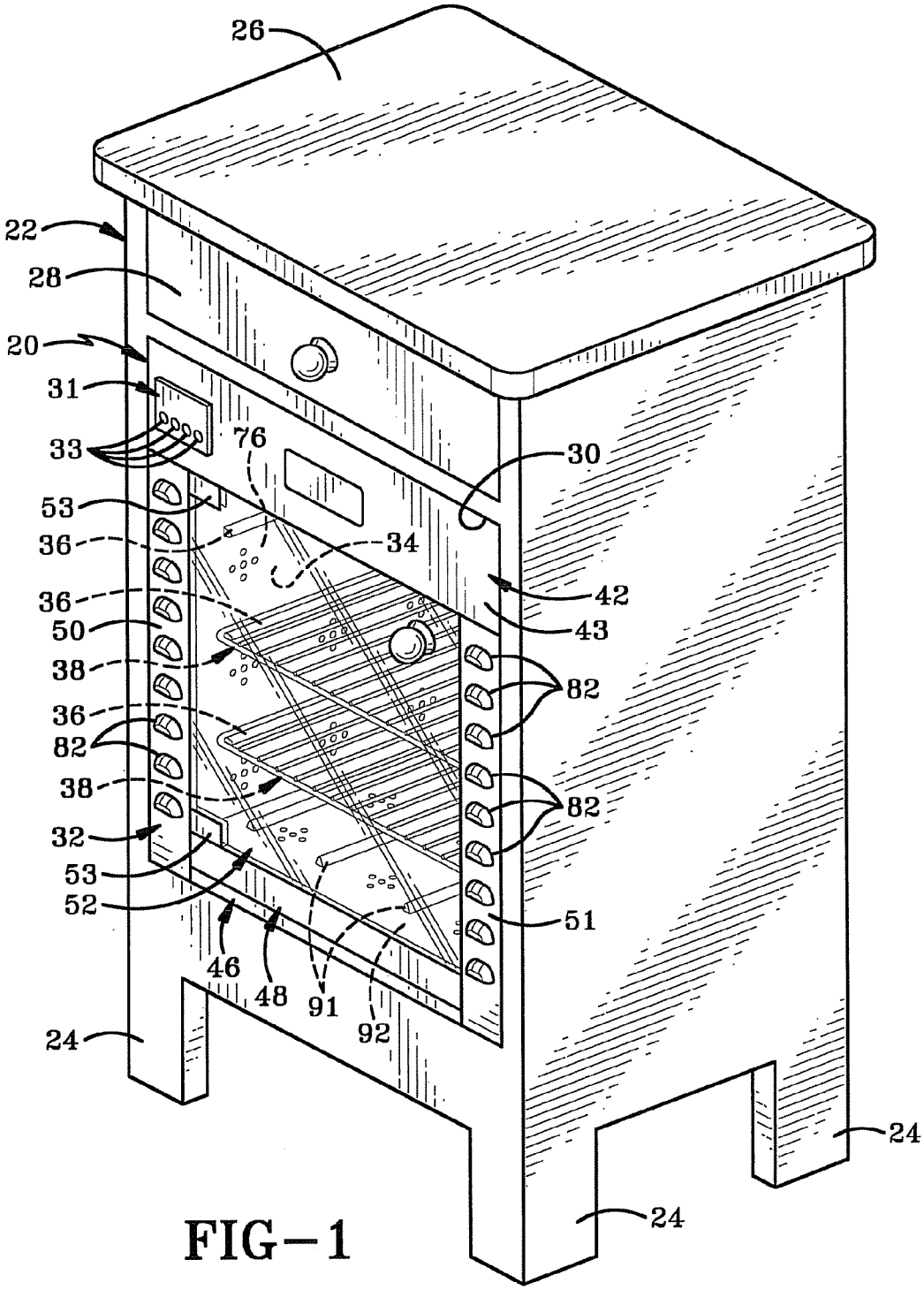
FIG. 1 is a perspective view of a preferred embodiment heating unit.

At the outset, it should be appreciated that like drawing numbers on different drawing views identify identical, or functionally similar, structural elements of the invention. While the present invention is described with respect to what is presently considered to be the preferred embodiment, it is to be understood that the invention as claimed is not limited to the disclosed aspects.

Unless defined otherwise, all technical and scientific terms used herein have the same meaning as commonly understood to one of ordinary skill in the art to which this invention belongs. Although any methods, devices or materials similar or equivalent to those described herein can be used in the practice or testing of the invention, the preferred methods, devices, and materials are now described.

A preferred embodiment heating unit of the present invention is indicated generally at 20, as is particularly shown in FIGS. 1 through 10. As specifically shown in FIG. 1, heating unit 20 may be located within cabinet 22. Cabinet 22 rests on legs 24 and includes a table surface 26 at the top and may include a drawer 28 or similar storage area.

In accordance with one of the main features of the present invention, cabinet 22 includes a chamber 30 adapted to receive heating unit 20. In a preferred embodiment, chamber 30 is located below drawer 28. Chamber 30 is preferably sized and shaped so that heating unit 20 fits flush within the cabinet and provides an aesthetically pleasing finished product. Further, by including heating unit 20 within chamber 30, the towel warmer and cabinet assembly utilizes valuable floor space which would otherwise be lost.

Figure 2:
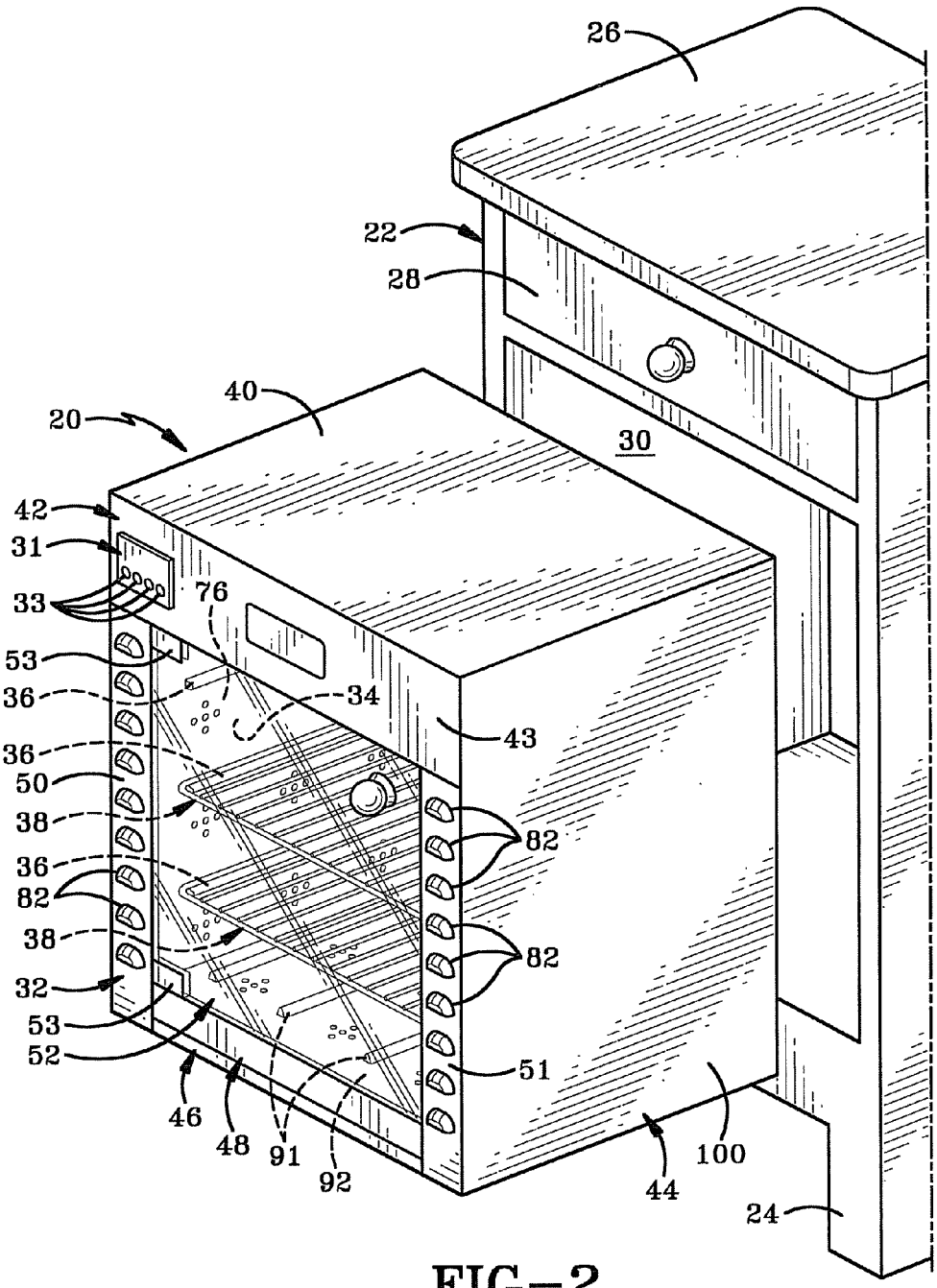
FIG. 2 is a perspective view of a preferred embodiment heating unit removed from its cabinet.

Referring to FIGS. 1 and 2, heating unit 20 includes a control panel 31 with operational controls 33 and may include an LCD or similar display device located within a front wall 43. The heating unit also includes an inner shell 32 defining an internal cavity 34. Inner shell 32 also includes rack mounts 36 formed in the inner shell side walls (discussed below). Rack mounts 36 on opposing side walls are each parallel to one another and may be formed by stamping. Since the rack mounts are arranged parallel, racks 38 can easily rest on the mounts. Racks 38 are preferably wire racks which allow air flow to move there through, although any suitable rack which allows air to pass through may be used and is within the spirit and scope of the present invention as claimed.

As seen in FIG. 2, the outer structure of heating unit 20 includes an upper cover 40, a ceiling panel 42 with front wall 43, an outer shell 44, a base pan 46, a floor panel 48, a first vent panel 50, a second vent panel 51, and a door 52. Internal cavity 34 is thus formed by ceiling panel 42 on the top, inner shell 32 on three sides, floor panel 48 on the bottom, and door 52 on the remaining side. Door 52 is secured to the heating unit with hinges 53 coupled to mounting holes 55 formed in both ceiling panel 42 and floor panel 48. While the preferred embodiment heating unit is illustrated and described as square or rectangular, any suitable shape may be incorporated, thereby increasing or decreasing the number of sides without departing from the spirit and scope of the present invention as claimed.

Figure 3:
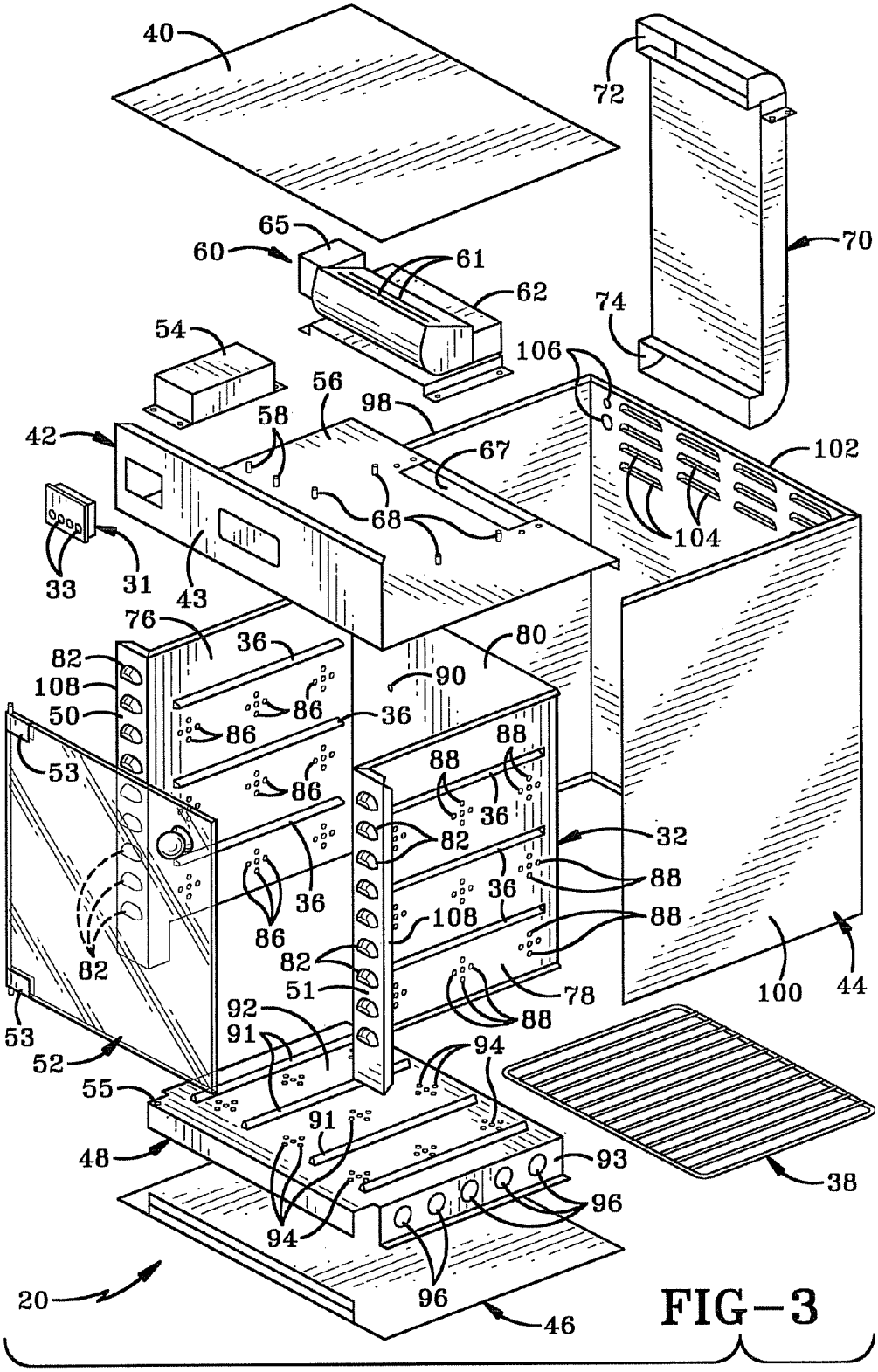
FIG. 3 is an exploded view of a preferred embodiment heating unit.
Figure 7:
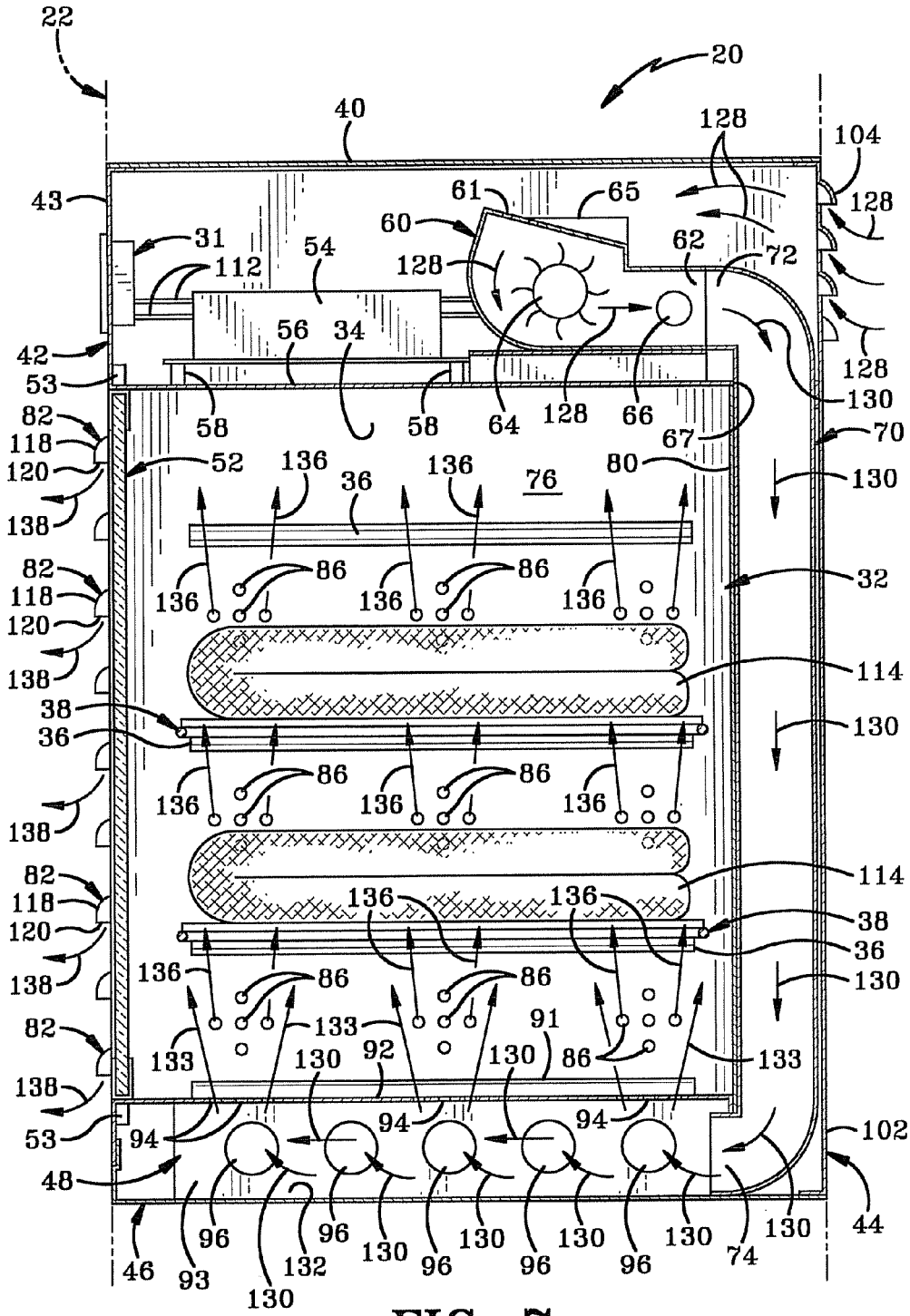
FIG. 7 is a sectional view of the preferred embodiment heating unit taken generally about line 7-7 in FIG. 6 with arrows indicating air flow.

Referring to FIG. 3, which is an exploded view of heating unit 20, the components of the heating unit are illustrated in greater detail. Heating unit 20 also includes a control board 54 mounted to a top side 56 of ceiling panel 42 on a plurality of studs 58. A housing 60 includes an inlet port 61 and an outlet port 62. The housing also contains a blower 64, a blower motor 65, and an induction coil 66 (FIG. 7). Housing 60 is secured to ceiling panel 42 on studs 68 with outlet port 62 directed towards the back side of the heating unit. Finally, ceiling panel 42 includes a hole 67 arranged to allow a duct 70 to connect to housing 60.

Duct 70 connects housing 60 and floor panel 48. Duct 70 has an inlet port 72 sized and shaped to connect with outlet port 62 of housing 60. Further, the duct includes an outlet port 74 arranged for connection with floor panel 48. In particular, both inlet port 72 and outlet port 74 are aligned parallel to one another and each connects to duct 70 proximate a ninety degree elbow.

In accordance with another main feature of the present invention, FIG. 3 illustrates inner shell 32 with a first side wall 76, a second side wall 78, a back wall 80, first vent panel 50, and second vent panel 51. First side wall 76 includes rack mounts 36 and a plurality of openings 86. Openings 86 are preferably arranged in groups and each group may be located below corresponding rack mounts 36. Therefore, if three rack mounts are utilized, there would be at least three groups of openings 86 located below the rack mounts. This arrangement is used because warm air rises and will surround a towel located on the rack mounts.

Second side wall 78 also includes a plurality of openings 88 arranged similar to openings 86 in first side wall 76 as described above. Back wall 80 preferably has a plurality of openings 90 arranged similar to openings 86 and 88 of the first and second side walls, respectively. In a preferred embodiment, first side wall 76 and second side wall 78 are parallel to each other and separated by back wall 80. Further, inner shell 32 may be formed of a single piece of material such as, but not limited to, stainless steel.

First vent panel 50 and second vent panel 51 each extend perpendicularly from the front end of their respective side wall and each include a plurality of ambient air vents 82 which will be described in greater detail below.

Floor panel 48 includes a top wall 92 with openings 94 and a pair of side walls 93 with openings 96. Side walls 93 raise top wall 92 above base pan 46 to permit airflow through openings 94 as well as openings 96. Floor panel 48 may also include ribs 91 which aid in strengthening the floor panel.

Still viewing FIG. 3, outer shell 44 is preferably formed with a first side wall 98, a second side wall 100, and a back wall 102. First side wall 98 and second side wall 100 are arranged parallel to each other and separated by back wall 102. Back wall 102 may include a plurality of intake vents 104 for air and apertures 106 for electrical cords. Further, an outer edge 108 of the first and second vent panels each rest against first side wall 98 and second side wall 100, respectively, to form an intermediate cavity 134 (described below).

Figure 4:
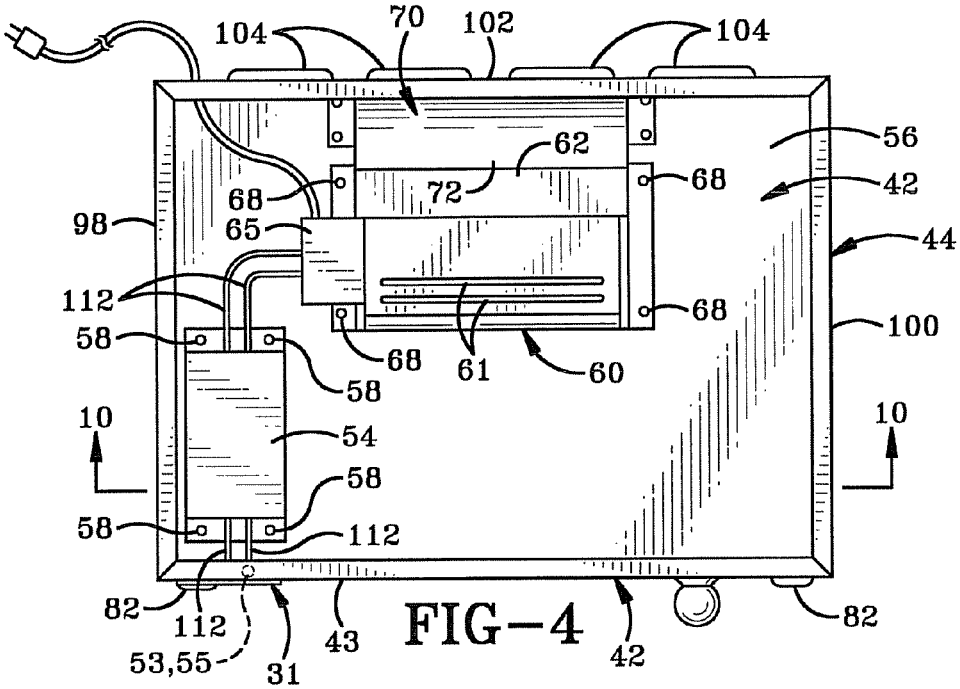
FIG. 4 is a top plan view of a preferred embodiment heating unit with an upper cover removed.

Referring to FIG. 4, wires 112 provide electrical communication between control panel 31, control board 54, blower 64, and induction coil 66. FIG. 4 also illustrates the interconnection of outlet port 62 of housing 60 and inlet port 72 of duct 70. Further, inlet port 61 provides air to housing 60 which can then be heated by induction coil 66 and blown through the heating unit by blower 64.

Figure 5:
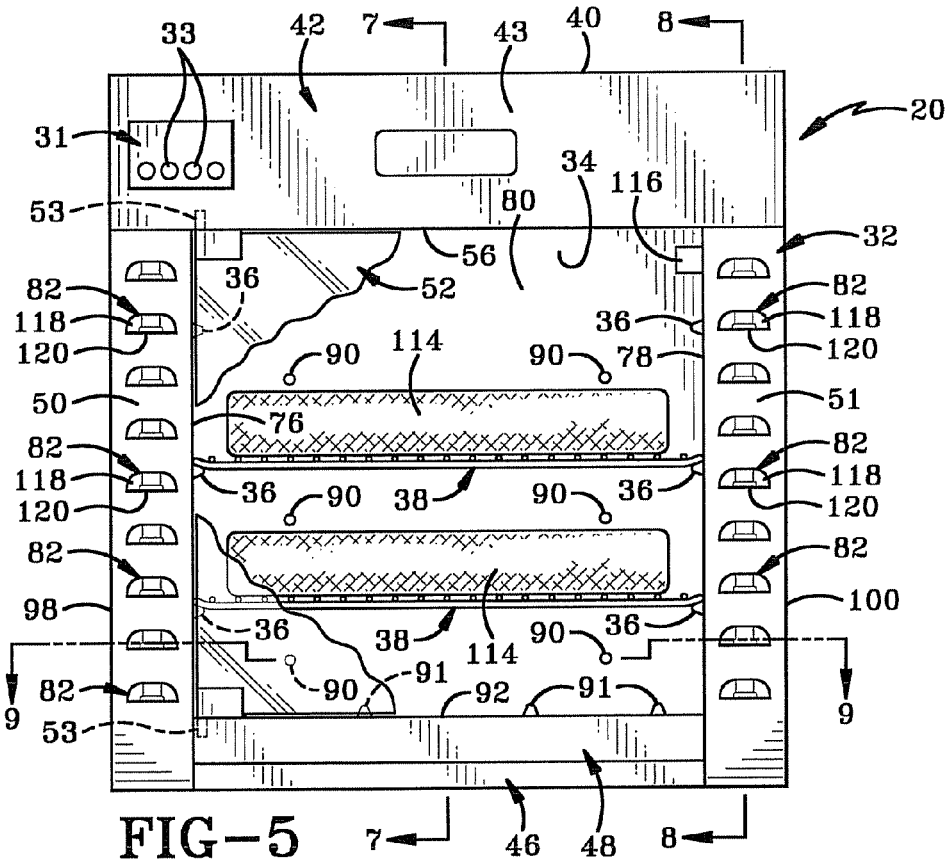
FIG. 5 is a front elevational view of a preferred embodiment heating unit removed from the cabinet with portions of the door removed.

FIG. 5 is a front view of the heating unit with towels 114 resting on racks 38 and a portion of door 52 removed. One additional feature only visible in FIG. 5 is a door stop 116. Door stop 116 is used to limit the travel of door 52.

In accordance with another main feature of the present invention, ambient air vents 82 on first vent panel 50 and second vent panel 51 are preferably arcuate in shape in a preferred embodiment. The ambient air vents include an arcuate shaped shroud 118 defining an orifice 120. Orifice 120 is preferably located on a bottom side of shroud 118 so that rising heated air must first contact the inside of the shroud before exiting orifice 120. Advantageously, this slows down the air flow out of the ambient air vents and helps to increase the temperature within the inner enclosure.

Figure 6:
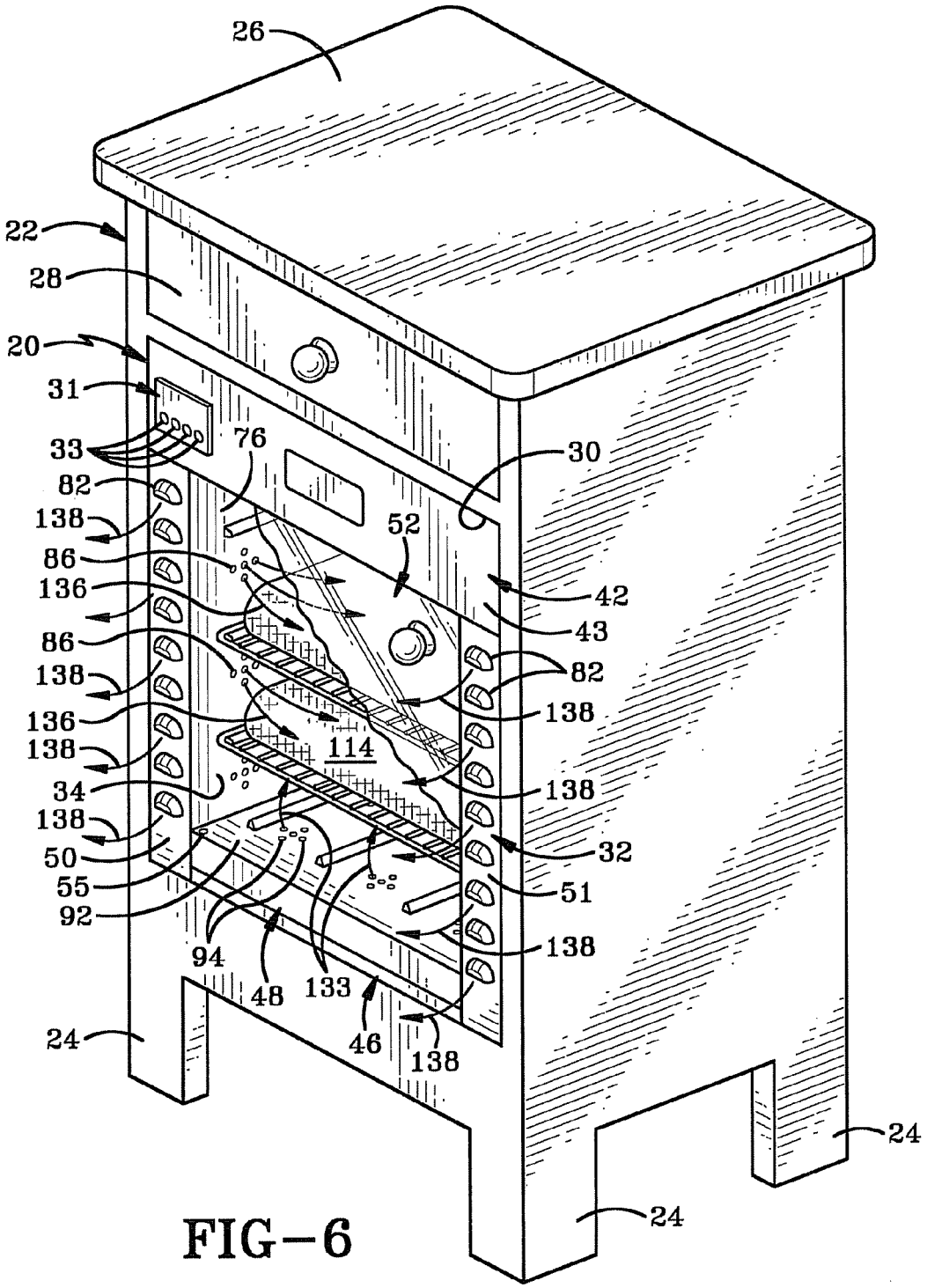
FIG. 6 is a perspective view of a preferred embodiment heating unit located within its cabinet with arrows indicating movement of the heated air, towels located on racks, and portions of the door removed.

Referring to FIG. 6, heating unit 20 is shown located within cabinet 22, with door 52 closed and the warmer in operation. An array of arrows 136 represents heated air entering internal cavity 34 through first side wall openings 86 in first side wall 76. Similarly, an array of arrows 133 represents heated air entering internal cavity 34 through openings 94 in floor panel 48. Finally, arrows 138 represent heated air passing though ambient air vents 82 through orifices 120. Not shown in FIG. 6, second side wall openings 86 and second side wall 78 perform similar to the first side wall and openings. Advantageously, this arrangement allows heated air to be directed into internal cavity 34 as well as the ambient air proximate the heating unit.

Having described the structure of the preferred embodiment, a preferred method of operation will be described in detail and should be read in light of FIGS. 1 though 10 and particularly FIGS. 7 through 10.

Referring to FIGS. 7 through 10, ambient air indicated by arrows 128 enters intake vents 104 in outer shell 44 and is directed to inlet port 61 of housing 60. Blower 64 then forces the ambient air past induction coil 66 to heat the ambient air. Heated air indicated by arrow 130 is then directed through duct 70 until it exits at outlet port 74 and into a base cavity 132.

Figure 8:
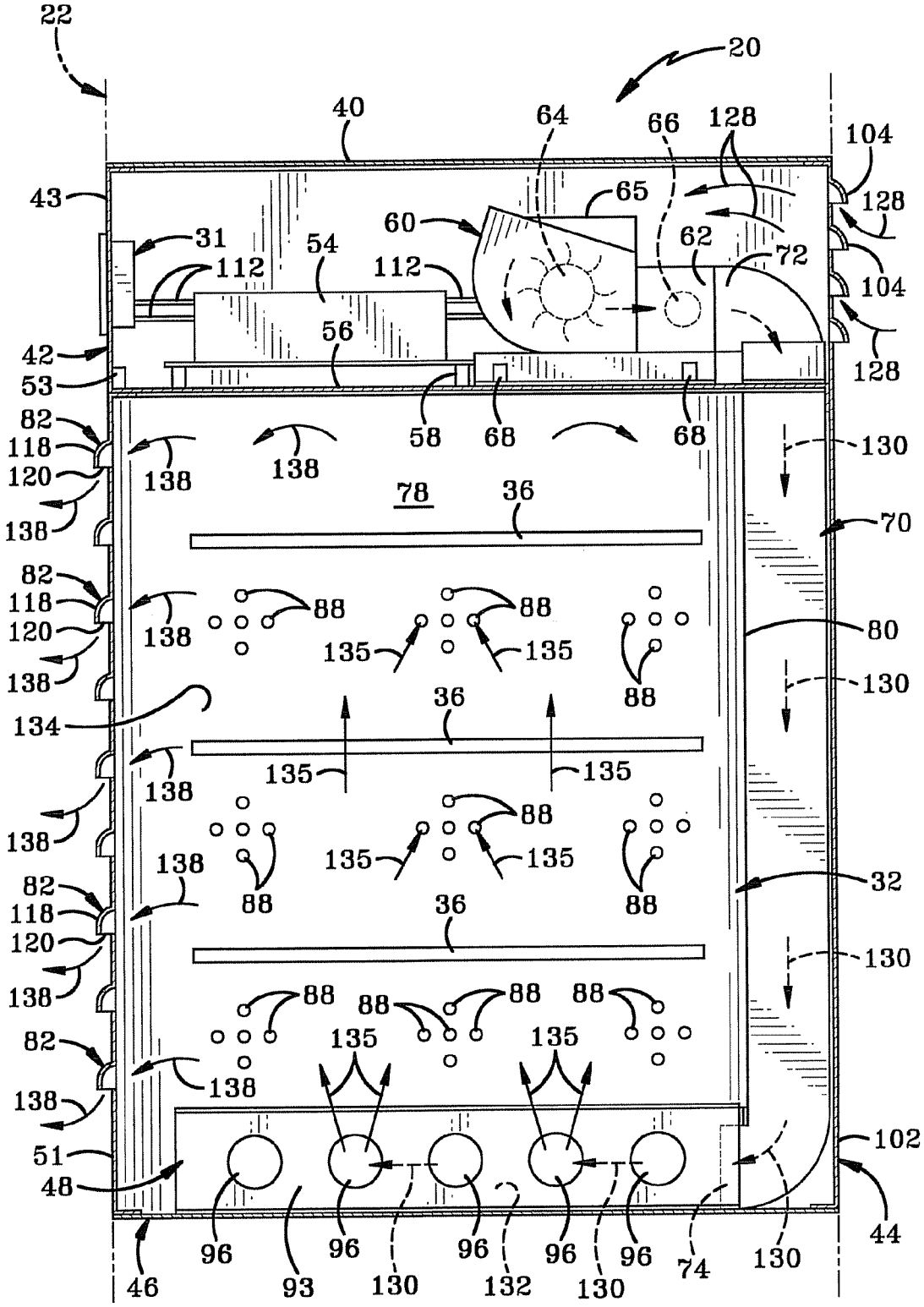
FIG. 8 is a sectional view of the preferred embodiment heating unit taken generally about line 8-8 in FIG. 6 with arrows indicating air flow.
Figure 9:
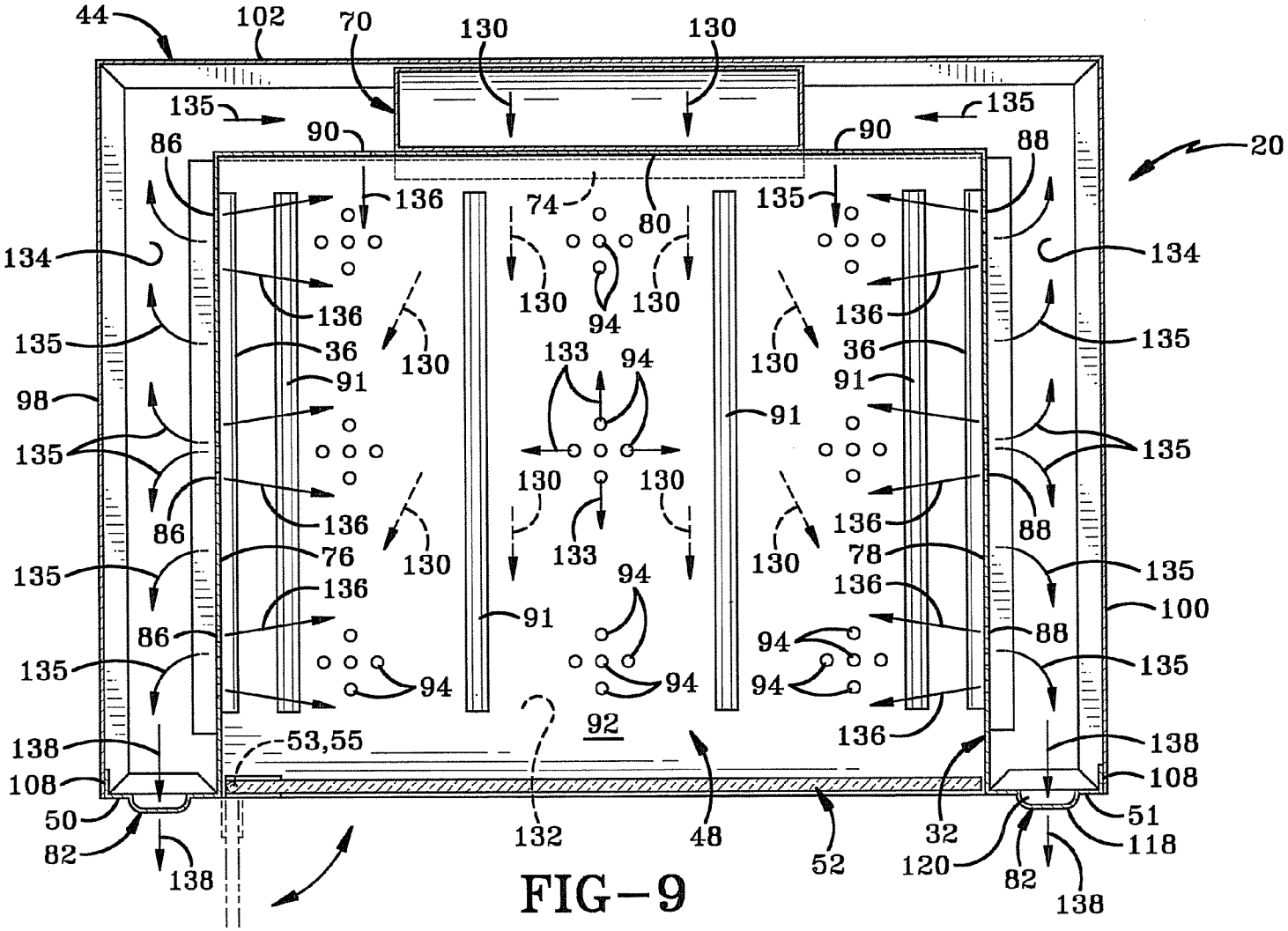
FIG. 9 is a sectional view of the preferred embodiment heating unit taken generally about line 9-9 in FIG. 6 with arrows indicating air flow.
Figure 10:
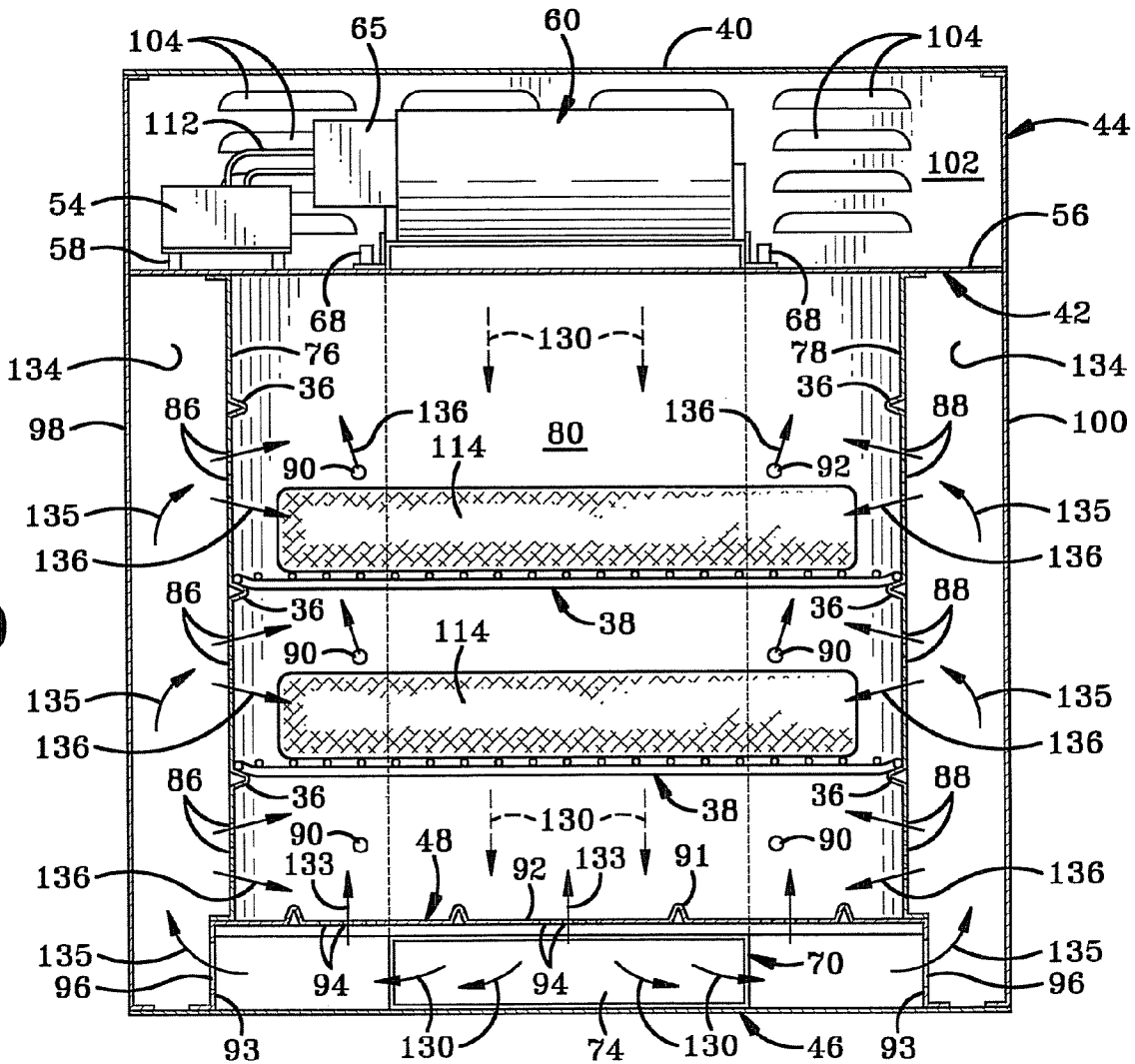
FIG. 10 is a sectional view of the preferred embodiment heating unit taken generally about line 10-10 in FIG. 5 with arrows indicating air flow.

From base cavity 132, the heated air moves in two directions. Part of the heated air rises directly upwards though openings 94 in floor panel 48 as indicated by arrows 133 (FIG. 7). The remaining portion of the heated air is directed outwards and through openings 96 in each side wall 93 of floor panel 48 as indicated by arrows 135 (FIG. 8). Once the heated air passes through openings 96, the heated air enters an intermediate cavity 134 formed between inner shell 32 and outer shell 44. Next, the heated air within the intermediate cavity rises upwards where some of the air passes through first side wall openings 86, second side wall openings 88, and back wall openings 90 as indicated by arrows 136 to enter internal cavity 34 and heat the towels. Further, the remaining heated air in the intermediate cavity rises upwards and passes through ambient air vents 82 and particularly orifice 120 of the ambient air vents as indicated by arrows 138 to heat the area immediately surrounding the towel warmer.

Having described the structure and operation of the first embodiment, only those portions of the second embodiment which are different from the first embodiment are described in detail. Likewise, similar numerals refer to similar parts throughout the various embodiments.

Figure 11:
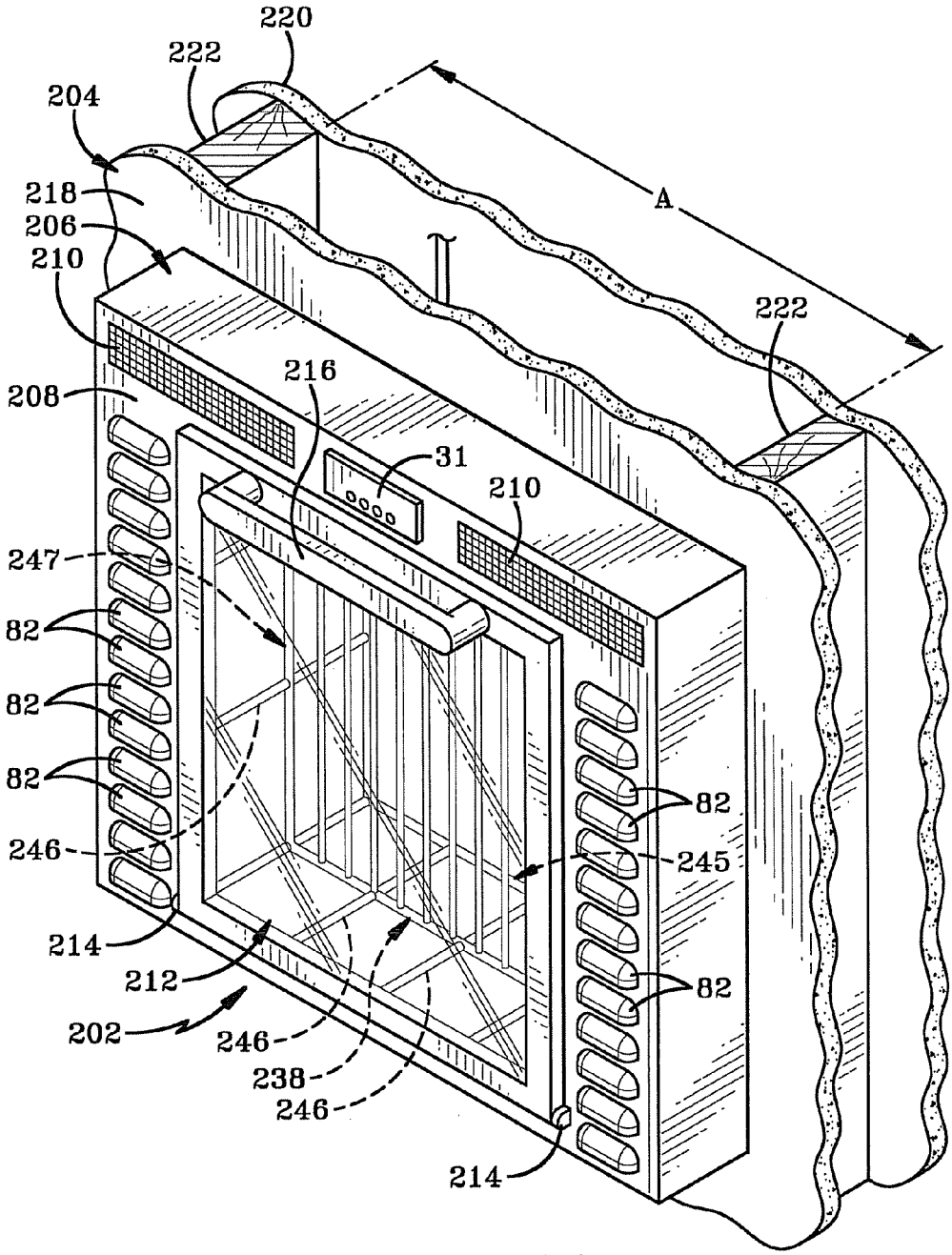
FIG. 11 is a perspective view of a second preferred embodiment heating unit secured within the wall with portions of the wall shown in section.
Figure 12:
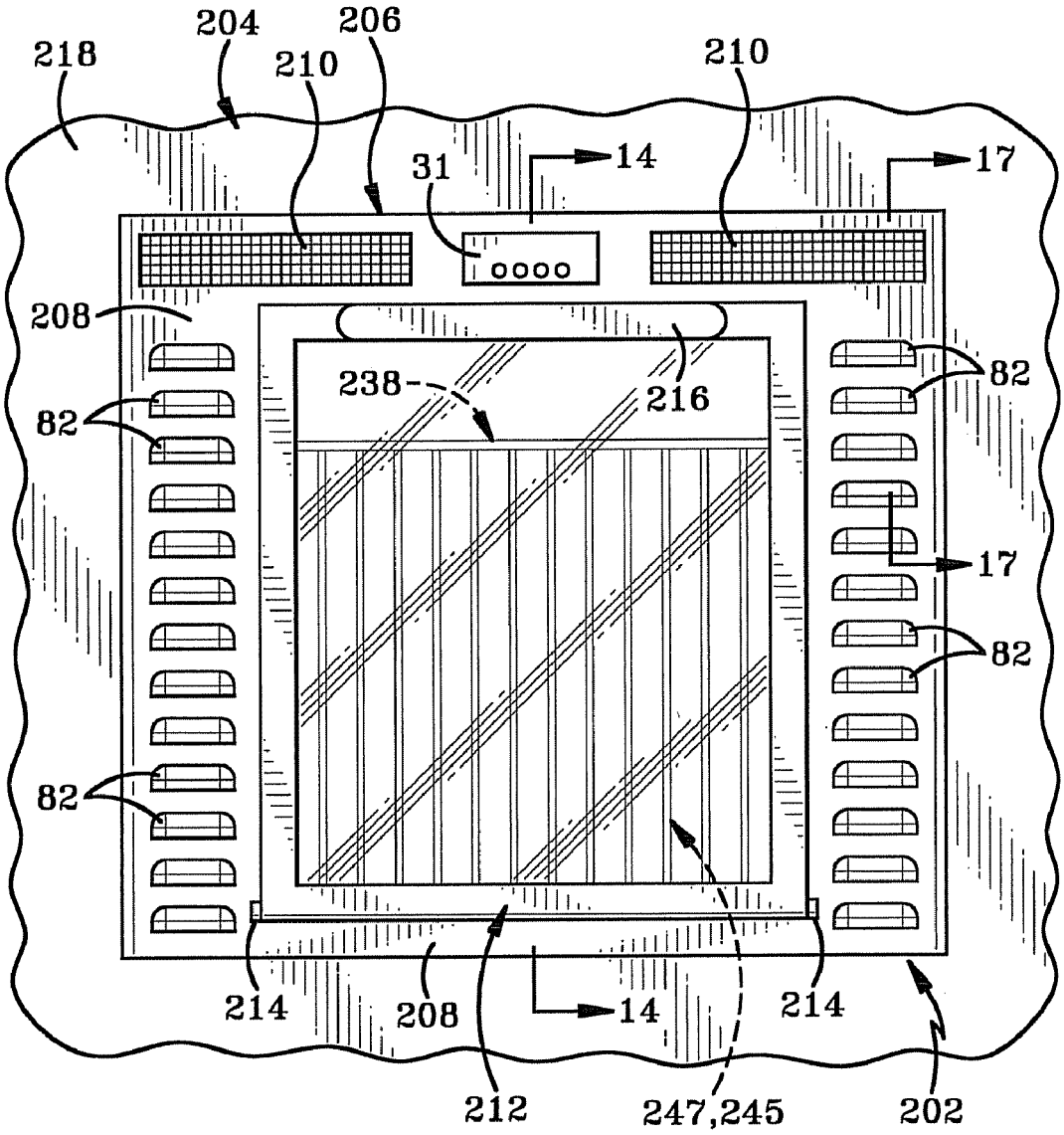
FIG. 12 is a front elevational view of a second preferred embodiment heating unit installed within a wall.

FIGS. 11 through 19 illustrate a second preferred embodiment heating unit 202 which can be installed within a wall 204. Heating unit 202 preferably includes an outer shell 206 which abuts wall 204 in the installed state. As seen in FIGS. 11 and 12, heating unit 202 includes a front wall 208. The front wall includes air intakes 210 as well as ambient air valves 82 similar to the first embodiment ambient air valves. Further, control panel 31 is also secured on front wall 208, while a door 212 is pivotably mounted at pivot points 214 such that the door is opened and closed by pushing and pulling handle 216.

Figure 13:
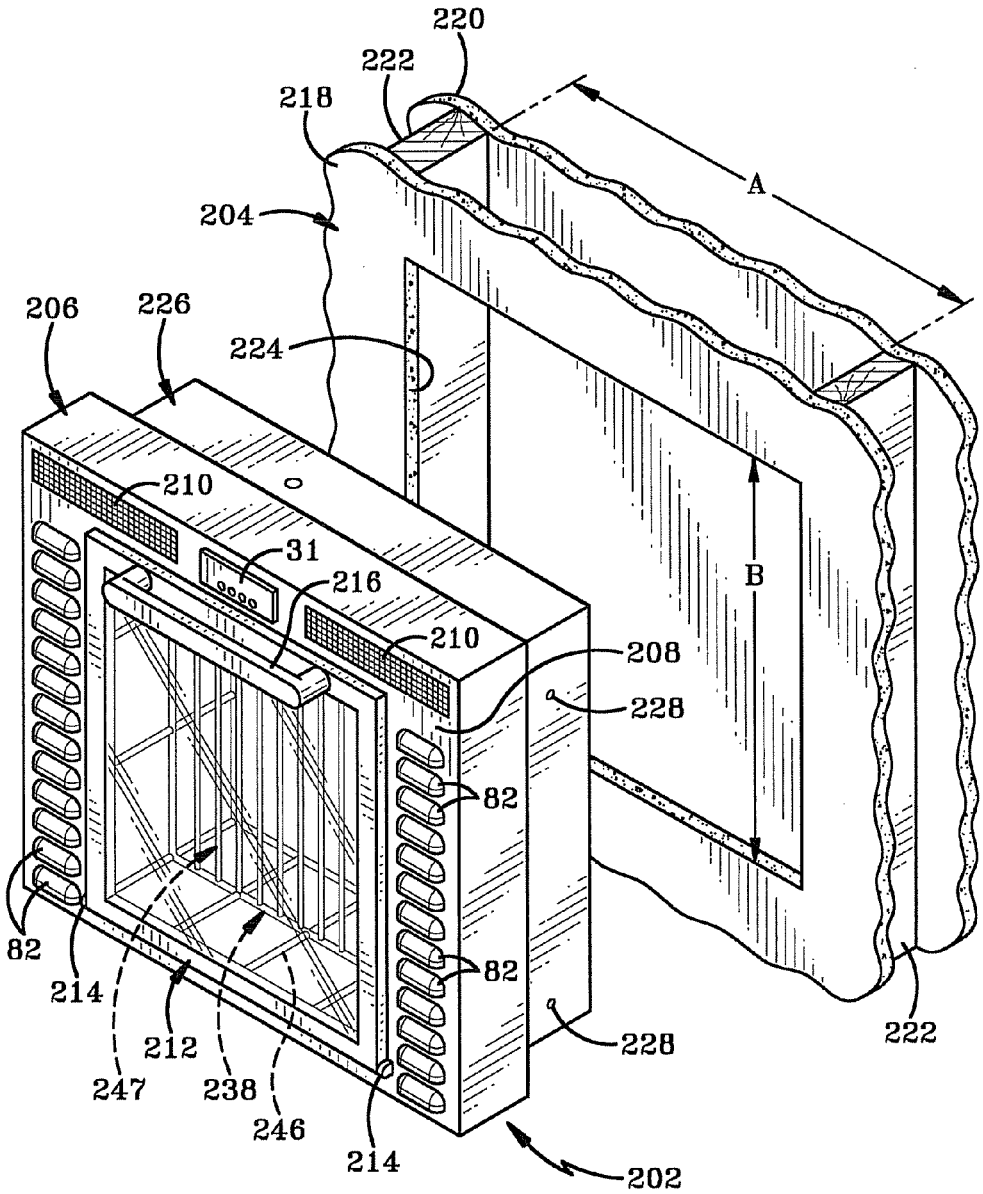
FIG. 13 is a perspective view of the heating unit removed from the wall.

In accordance with yet another main feature of the present invention, FIG. 13 illustrates heating unit 202 removed from wall 204. In a preferred embodiment, wall 204 includes an outer wall 218 and inner wall 220, with studs 222 separating the walls. An opening 224 is disposed within outer wall 218 and is arranged approximately a distance A wide and a height B tall. Heating unit 202 also includes a rear outer shell 226 with mounting holes 228 arranged throughout the periphery of the rear outer shell. Rear outer shell 226 is preferably shaped and sized complimentary to opening 224 in outer wall 218, and has a depth approximately equal to the distance between outer wall 218 and 220 thereby allowing the outer shell 206 to rest against outer wall 218. Advantageously, this arrangement allows the heating unit to rest at least partially within the wall in an effort to save space.

Figure 14:
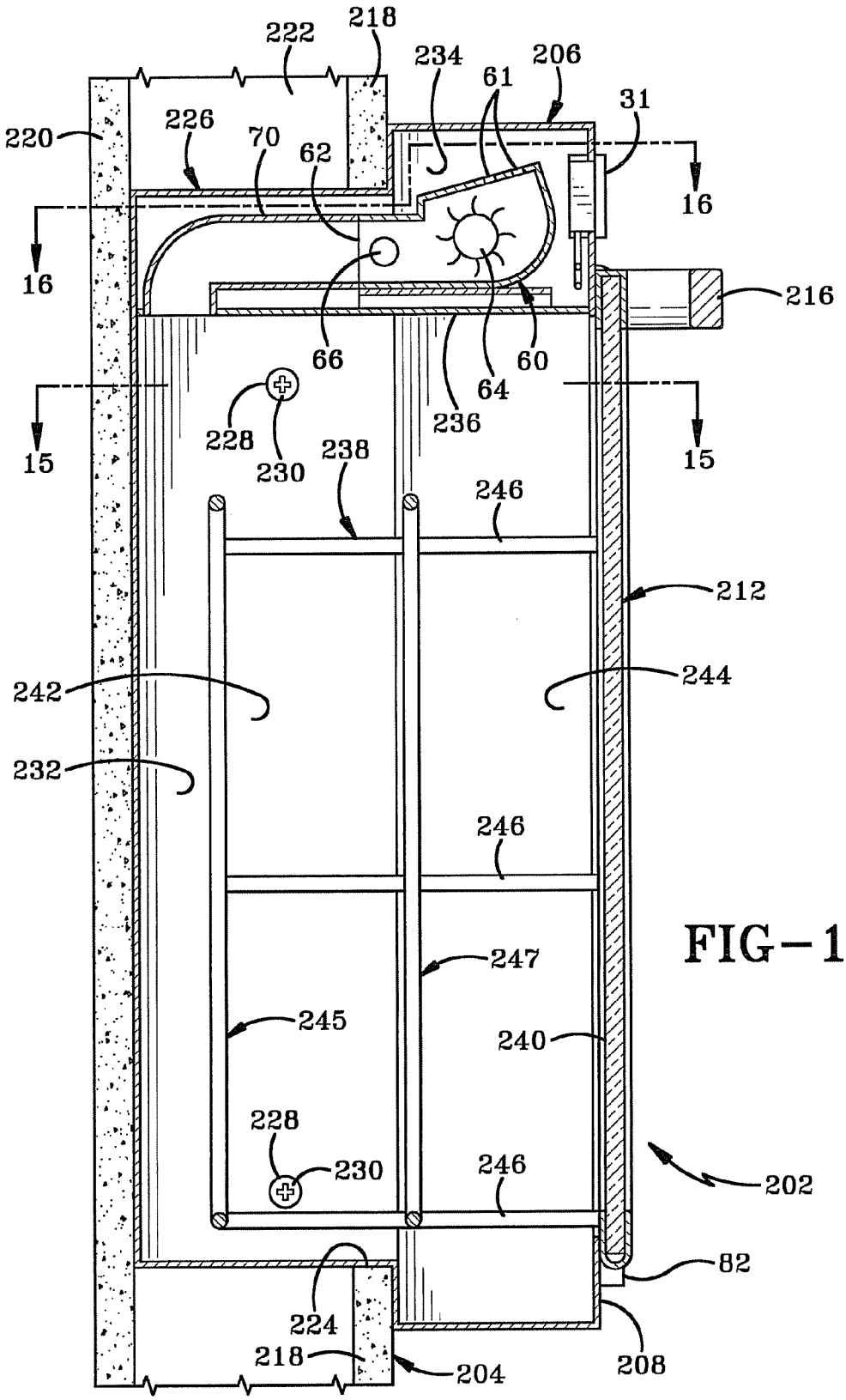
FIG. 14 is a sectional view of the preferred embodiment heating unit taken generally about line 14-14 in FIG. 12.
Figure 15:
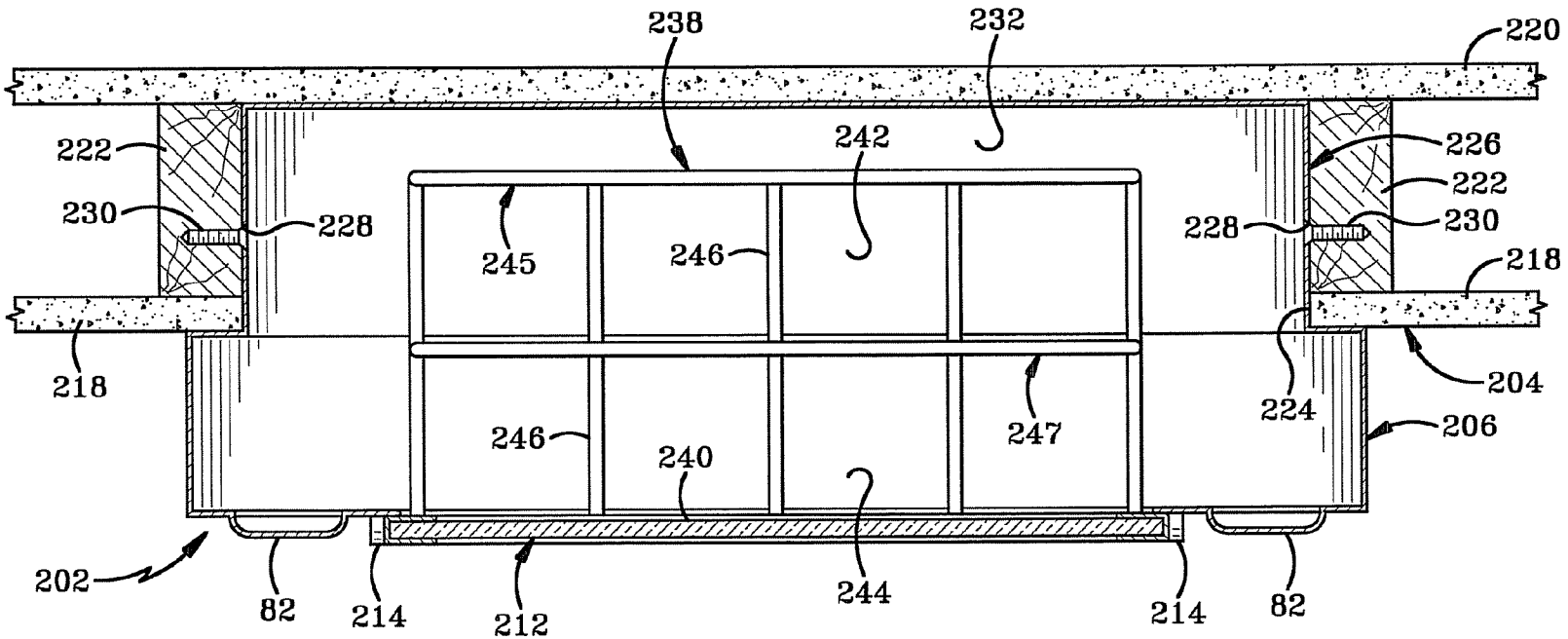
FIG. 15 is a sectional view of the second preferred embodiment heating unit taken generally about line 15-15 in FIG. 14.
Figure 16:
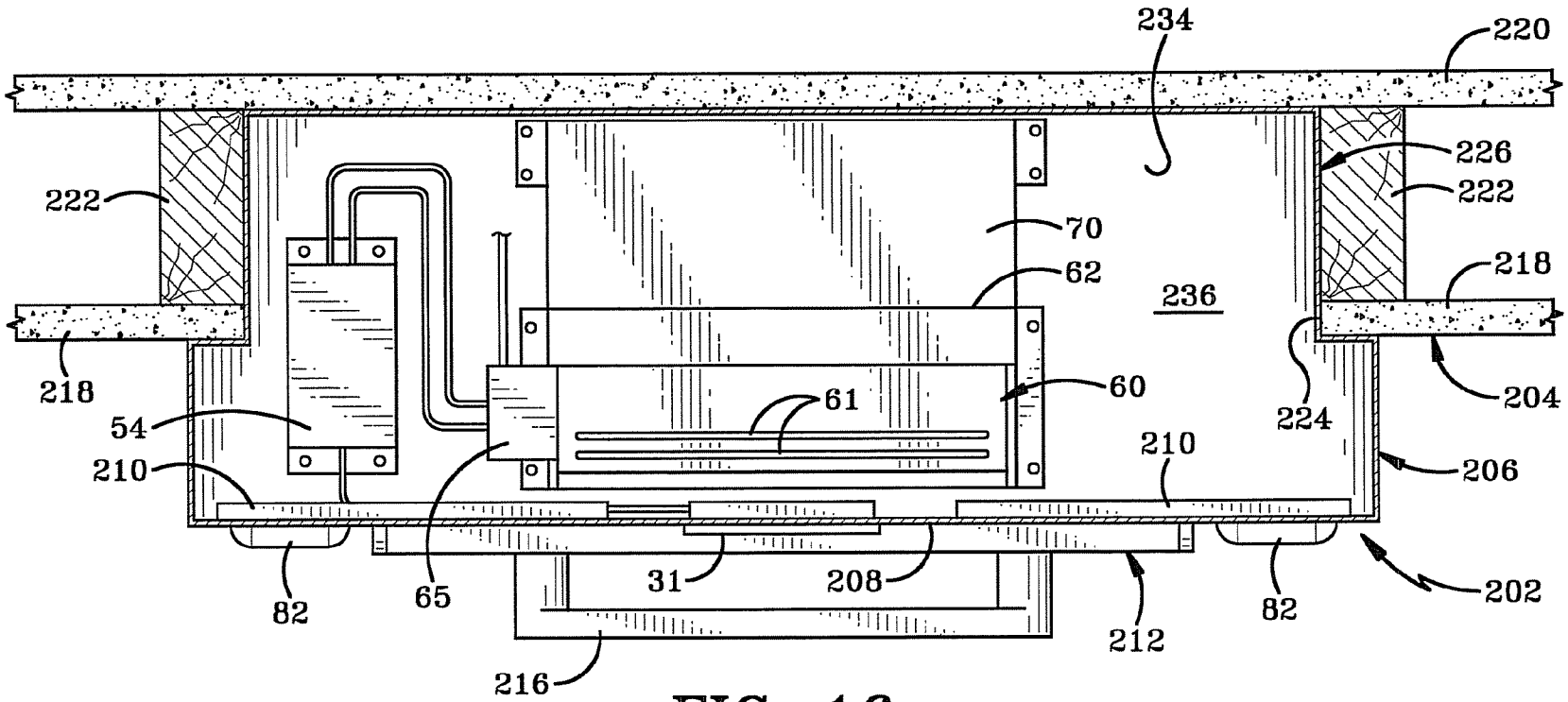
FIG. 16 is a sectional view of the second preferred embodiment heating unit taken generally about line 16-16 in FIG. 14 and illustrating the heating unit and air distribution device.

FIGS. 14, 15 and 16 illustrate sectional views of the second preferred embodiment heating unit mounted within wall 204. Particularly, heating unit 202 is secured to studs 222 by installing screws 230 through mounting holes 228. Outer shell 206 and rear outer shell 226 define an internal cavity 232 which also includes a control cavity 234. Control cavity 234 contains housing 60 with inlet port 61, blower 64 and induction coil or other heating device 66. Further, connected at outlet port 62 is duct 70, which passes heated air from induction coil 66 into internal cavity 232. Finally, a separating wall 236 creates a barrier between internal cavity 232 and control cavity 234.

A rack assembly 238 is located within internal cavity 232 and is preferably connected to a back side 240 of door assembly 212. Rack assembly 238 includes a first opening 242 and a second opening 244 in a preferred embodiment. Advantageously, both the first and second rack openings are arranged to vertically locate towels within the openings to allow easy installation and removal from the racks. Rack assembly 238 includes a first vertical wall 245 and a second vertical wall 247, with side bars 246 connecting the vertical walls and preventing the towels from falling out from the side. The rack assembly is preferably a steel or alloy material. Advantageously, this arrangement allows rack assembly 238 to be accessible when door 212 is pivoted open at pivot points 214. Thus, a user can insert or remove towels when the door is open, but cannot disturb the towels when the door is closed.

Figure 17:
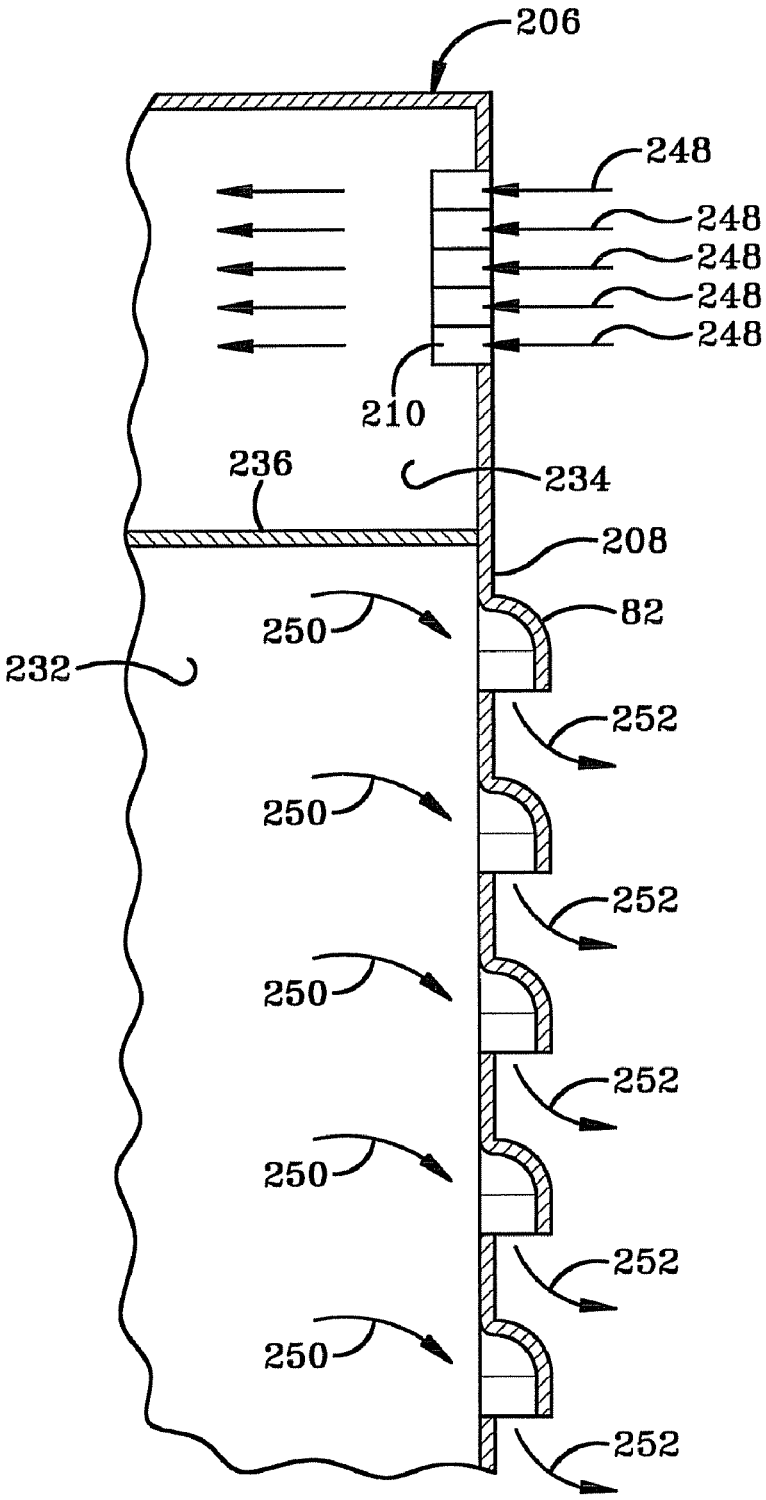
FIG. 17 is a sectional view of the second preferred embodiment heating unit taken generally about line 17-17 in FIG. 12 with arrows indicating air flow.

Referring to FIG. 17, still another aspect of the present invention is illustrated in which ambient air 248 is pulled in through air intake 210 into control cavity 234. Ambient air 248 is then directed into the heating unit (not shown) and becomes heated air 250 after passing through the heating unit and being directed into internal cavity 232. Once heated air 250 is within internal cavity 232, the heated air is then directed through ambient air valves 86 as indicated by arrows 252 and achieves the goal of heating the ambient air proximate the heating unit.

In the above description, ambient air is indicated by arrows 248, while heated air within the internal cavity 232 is indicated by arrows 250 and heated ambient air expelled from ambient air valves is indicated by arrows 252.

Figure 18:
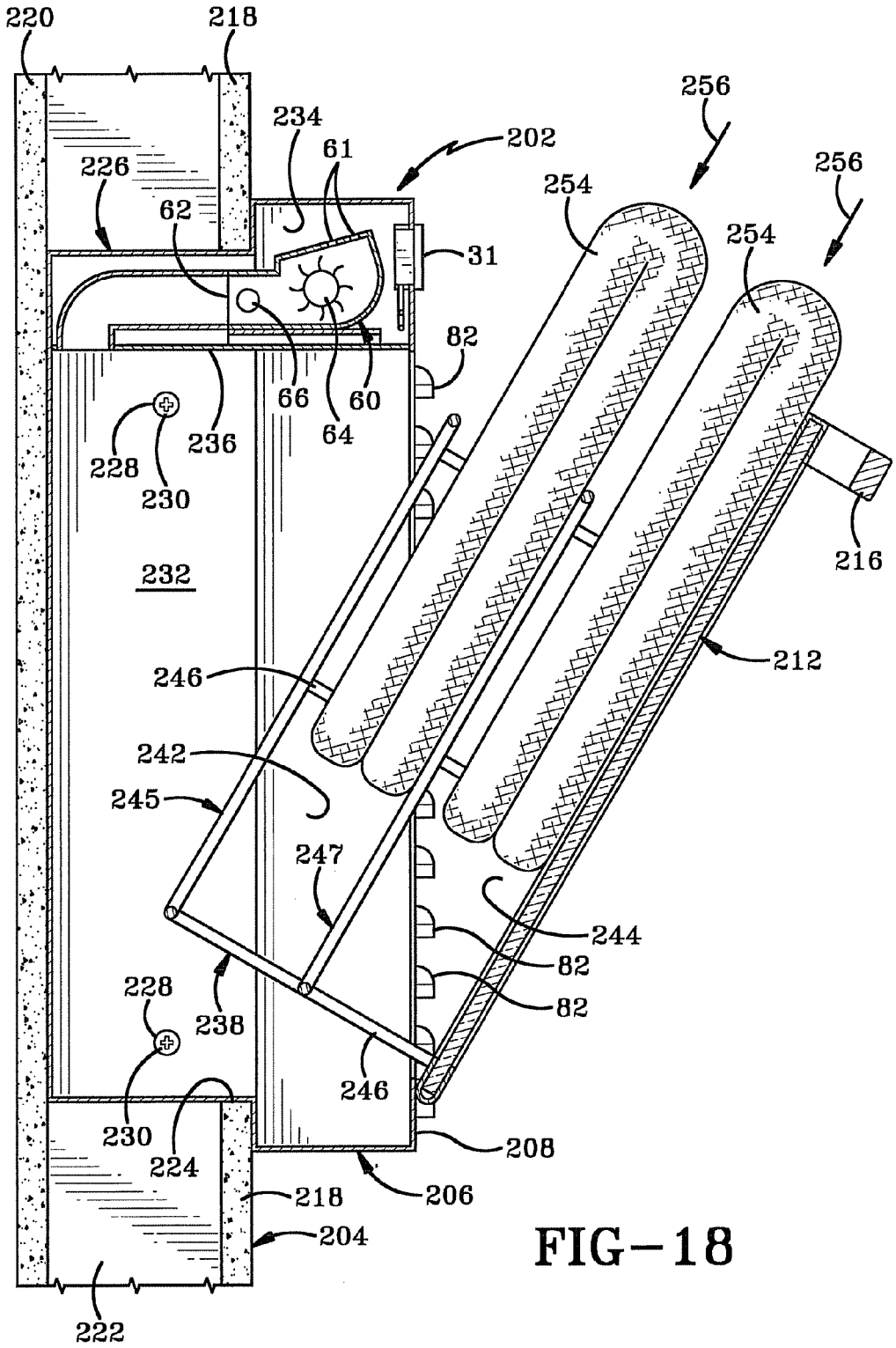
FIG. 18 is a sectional view with the door assembly of the second preferred embodiment heating unit open and towels being inserted within the rack; and, FIG. 19 is a sectional view of the second preferred embodiment heating unit with the door closed and heated air warming the towels within the internal cavity.
Figure 19:
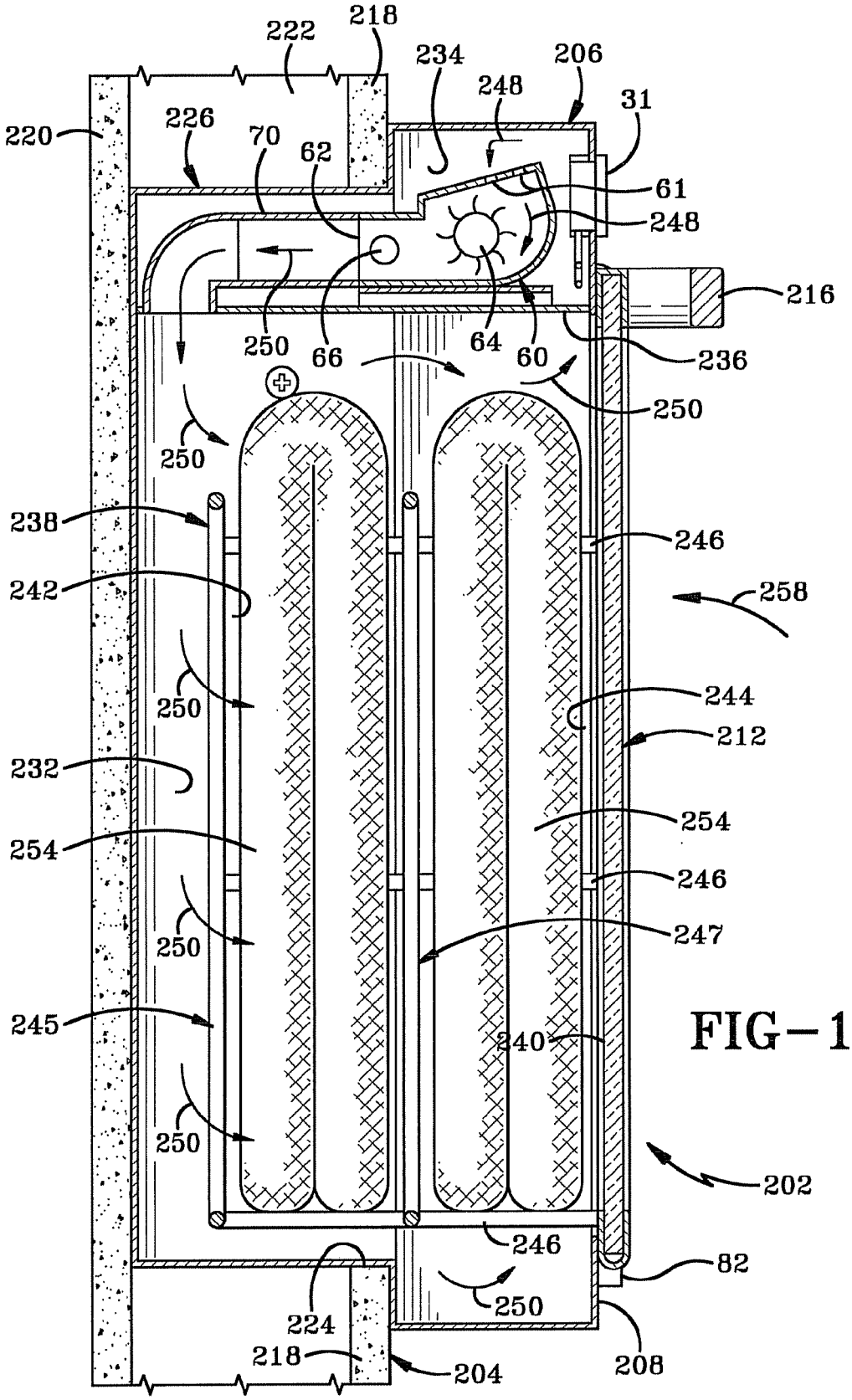

FIGS. 18 and 19 illustrate the operation of the second preferred embodiment heating unit. In FIG. 18, door 212 has been pivoted open at pivot points 214, thereby exposing internal cavity 232 and rack assembly 238. As seen in FIG. 18, towels 254 are inserted in the direction of arrow 256 until the towels are completely seated within rack assembly 238. Next, door 212 is pivoted shut in the direction of arrow 258 and the heating unit is now prepared for operation. Next, the heating unit is turned on by operating control panel 31 and ambient air 248 is directed into control cavity 234 by blower 64. Ambient air 248 is then directed into inlet ports 61 of the blower housing and passed heating unit 66 to form heated air 250. Heated air 250 is then forced through duct 70 and into internal cavity 232. The heated air within the internal cavity warms towels 254 as well as exits ambient air valves 82.

In operation, the heating unit is open to receive towels for warming, and then the internal cavity is sealed by closing the door. Next, ambient air is directed through a heating source with a distribution device until the heated air is then forced into the internal cavity and through a plurality of ambient airs thereby warming the towel within the internal cavity as well as the ambient air proximate the ambient air valves. Further, if an intermediate cavity is utilized, the heated air is forced through the duct and into the intermediate cavity where the heated air traverses the ambient air valves as well as passes into the internal cavity. In addition, the heated air passes from the intermediate cavity through a plurality of openings which communicate between the intermediate cavity and the internal cavity. Finally, in a preferred embodiment, the heated ambient air which has been expelled from the ambient air valves is directed back into the air intake where the previously heated air is again heated to a higher temperature to increase the heated air temperature within the internal cavity.

Thus, heating unit 20 or 202 provides a mechanism for easily and efficiently warming towels within an internal cavity as well as warming the ambient air surrounding the heating unit. Further, the heating unit can be located within a cabinet which provides storage or within a wall, both of which provide an aesthetically pleasing design to maximize storage space while warming towels.

It will be evident to one skilled in the art that a variety of changes can be made that are within the spirit and scope of the present invention. For instance, the blower and induction coil could be located directly below the floor panel, thereby remedying the need for duct work. Further, a door is not necessary to warm both the ambient air and the towels and may in fact be completely removed to increase the ambient air warming.

Accordingly, the heating unit is an effective, safe, inexpensive, and efficient device that achieves all the enumerated objectives of the invention, provides for eliminating difficulties encountered with prior art devices, systems, and methods, and solves problems and obtains new results in the art.

In the foregoing description, certain terms have been used for brevity, clearness, and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries, and principles of the invention, the manner in which the heating unit is constructed and used, the characteristics of the construction, and the advantageous new and useful results obtained; the new and useful structures, devices, elements, arrangement, parts, and combinations are set forth in the appended claims.

What is claimed is:

1. A heating unit comprising:

a shell defining an internal cavity having a pair of external sidewalls and a rear wall:

a heating source;

ducting operationally extending between the heating source and the internal cavity;

a plurality of ambient air valves in communication with the internal cavity and the ambient air;

whereby the ambient air valves are adapted to allow air to pass therethrough from the internal cavity to the ambient air; and an opening accessible from a front side and the ambient air valves are disposed on a front wall of the shell bordering the opening.

2. The heating unit of claim 1 wherein the ambient air vents are sized to assure that the air in the internal cavity initially receives more air than is released.

3. The heating unit of claim 1 further comprising a rack within the internal cavity adapted to support an article to be warmed.

4. The heating unit of claim 3 further comprising an internal wall dividing the internal cavity and wherein the heating source is positioned on one side of the internal wall and the rack is positioned on an opposing side of the internal wall.

5. The heating unit of claim 1 wherein the internal cavity further comprises a plurality of holes in communication with the ducting.

6. The heating unit of claim 5 wherein the plurality of holes have a combined cross-sectional area equal to or greater than a combined cross-sectional area of the ambient air valves.

7. The heating unit of claim 6 wherein the plurality of holes receive air at the same time as the ambient air valves.

8. The heating unit of claim 7 further comprising:

an internal wall spaced from at least one of the external sidewalls, the rear wall and a bottom wall;

a cavity extending intermediate the internal wall and the at least one external sidewall and rear wall; and, wherein the internal cavity retains at least a portion of the ducting.

9. The heating unit of claim 7 further comprising:

an internal wall spaced from at least one of the external sidewalls and the rear wall;

a cavity extending intermediate the internal wall and the at least one external sidewall, the rear wall and bottom wall; and, wherein the internal cavity creates at least a portion of the ducting.

10. The heating unit of claim 6 wherein the plurality of holes are formed in the internal wall.

11. The heating unit of claim 10 wherein the internal wall extends adjacent the external sidewalls and the rear wall.

12. The heating unit of claim 3 wherein the rack is carried by a door.

13. The heating unit of claim 1 further comprising a piece of furniture defining a cavity and wherein the shell is sized to fit within the furniture cavity, wherein the piece of furniture is generally rectangular in shape with a width between 10 inches and 24 inches, a height between 14 and 40 inches and a depth between 12 and 36 inches.

14. The heating unit of claim 1 wherein the shell further comprises a plurality of mounting holes for securing the heating unit to a wall through the plurality of mounting holes with a plurality of fasteners.

* * * * *